US005873332A

United States Patent [19]

Taue et al.

[11] Patent Number: 5,873,332

[45] Date of Patent: Feb. 23, 1999

[54] WATER PROPULSION UNIT HAVING A "V" SHAPED MULTI-CYLINDER CRANKCASE SCAVENGING ENGINE

[75] Inventors: Jun Taue; Masaichi Yamada, both of Iwata, Japan

[73] Assignee: Yamaha Hatsudoki Kabushiki Kaisha, Iwata, Japan

[21] Appl. No.: 871,351

[22] Filed: Jun. 9, 1997

[30] Foreign Application Priority Data

Jun. 7, 1996 [JP] Japan ..... 8-145739

[51] Int. Cl.[6] ..... F02B 75/02

[52] U.S. Cl. ..... 123/52.4; 123/54.4; 123/317

[58] Field of Search ..... 123/317, 318, 123/52.4, 54.4, 580, 184.36

[56] References Cited

U.S. PATENT DOCUMENTS

| | | | |
|---|---|---|---|
| 2,634,711 | 4/1953 | Pielstick | 123/52.4 |
| 3,859,968 | 1/1975 | Stinebaugh | 123/317 |
| 4,787,344 | 11/1988 | Okumura et al. | 123/54.4 |
| 5,377,634 | 1/1995 | Taue . | |
| 5,438,963 | 8/1995 | Tsunoda et al. | 123/54.4 |
| 5,456,230 | 10/1995 | VanRens et al. | 123/317 |
| 5,678,525 | 10/1997 | Taue | 123/377 |
| 5,738,051 | 4/1998 | Binversie et al. | 123/317 |

*Primary Examiner*—Marguerite McMahon
*Attorney, Agent, or Firm*—Knobbe, Martens, Olson & Bear LLP

[57] ABSTRACT

A watercraft is propelled by an outboard motor having a water propulsion device powered by a multi-cylinder engine of a crankcase compression type, the engine positioned within a cowling of the motor. The engine has a very compact V type arrangement. The intake system for admitting the charge to the crankcase chambers and the exhaust manifold are positioned around the outside of the engine opposite its valley. A compressor delivery to the cylinder head intake ports is positioned within the valley. The engine includes at least one crankshaft which drives a drive shaft of the water propulsion device of the motor.

18 Claims, 10 Drawing Sheets

WATER PROPULSION UNIT HAVING A "V" SHAPED MULTI-CYLINDER CRANKCASE SCAVENGING ENGINE

FIELD OF THE INVENTION

This invention relates to a high performance, compact, "V" type, multi-cylinder internal combustion engine of a crankcase compression type arranged to fit within a cowling of an outboard motor for powering a water propulsion device of the motor.

BACKGROUND OF THE INVENTION

A wide variety of systems employ two-cycle internal combustion engines as their power plants. One reason why two-cycle engines are utilized for these applications is because of their high specific output and relatively compact size. For example in substantially all watercraft applications, particularly those of the smaller type of pleasure craft and utility craft, the space available for the engine is quite restricted. Therefore, it is desirable to be able to utilize an engine that has high specific output and a compact configuration. This is particularly true in connection with outboard motors. As is well known, with an outboard motor the engine is positioned in the powerhead and the outboard motor is normally mounted in the transom of the watercraft which it propels. This obviously requires a compact power plant.

The compact and simple nature of two-cycle engines, however, gives rise to certain problems. Because of the scavenging system employed and the inherent overlap in the port timing, it is more difficult to control the exhaust emissions with two-cycle engines, particularly when the engine runs over a wide variety of speeds and loads. In addition, the lubricating system employed with two-cycle engines can, at times, also give rise to emission problems.

Therefore, there is an increasing desire to substitute four-cycle engines for two-cycle engines in watercraft propulsion systems. This trend is arising not only in outboard motors but also in the power plants for small watercraft such as personal watercraft that have also normally used two cycle engines. However, these applications do require compact engines and engines that provide high power outputs for their size.

It is, therefore, a principal object of this invention to provide an improved and compact power plant arrangement.

It is a further object of this invention to provide an improved, compact and yet high output engine that can be utilized for marine propulsion.

It is a still further object of this invention to provide an improved high output compact four-cycle internal combustion engine and watercraft propulsion system utilizing such an engine.

An engine which has the capability of providing high specific output is disclosed in U.S. Pat. No. 5,377,634 entitled "Compressor System For Reciprocating Machine", issued Jan. 3, 1995 in the name of the one of the inventors hereof and which application is assigned to the Assignee hereof. In that patent, however, the engine has a relatively large overall dimension even though it provides a high power output for its displacement. Also, that patent illustrates only a single cylinder engine and in many applications, multiple cylinder engines are desirable.

It is, therefore, a still further object of this invention to provide an improved engine of the type shown in that patent that it has a compact induction and exhaust system and which employs multiple cylinders.

In many applications and particularly those employed in watercraft propulsion systems, a "V"-type configuration is employed for the engine in order to provide a more compact power unit. With the type of engine shown in the aforenoted U.S. Pat. No. 5,377,634, the intake charge is delivered to the crankcase chambers for compression at one side thereof. The compressed charge is delivered to a plenum chamber at the other side of the engine which supplies the intake ports of the engine through intake passages formed in the cylinder head. In addition, an exhaust manifold is also required to collect the exhaust gases and deliver them to the atmosphere. Obviously, these added components and their positions can present problems in conjunction with installation in a marine propulsion system.

It is, therefore, a still further object of this invention to provide an improved engine of the type shown in that patent that it has a compact induction and exhaust systems and which employs multiple cylinders in a "V" type configuration.

SUMMARY OF THE INVENTION

This invention is an engine adapted to be positioned within a cowling of an outboard motor for use in powering a water propulsion device of the motor, the motor in turn adapted to power a water vehicle.

Preferably, the engine is of the four cycle, "V" type, having a pair of cylinder banks defined by a pair of cylinder blocks disposed at a "V" angle to each other and forming a valley therebetween. Each of the cylinder blocks has at least one cylinder bore. A crankcase is formed at one end of the cylinder bores and forms a plurality of crankcase chambers each associated with a respective cylinder bore. Each of pair of cylinder heads close the other end of a respective one of the cylinder blocks. A plurality of pistons each reciprocating in a respective one of said cylinder bores and forming with said cylinder bores and the cylinder heads a plurality of combustion chambers.

Crankshaft means are rotatably journalled in the crankcase. A plurality of connecting rods each couple a respective one of the pistons and the crankshaft means for transmitting motion therebetween. Means for providing a seal so that the pistons, the cylinder bores, the connecting rods, the crankshaft means and the crankcase chambers acting as a plurality of positive displacement pumps.

Intake means positioned adjacent the crankcase and generally opposite the valley of the engine deliver and air and fuel charge into each crankcase chamber. Delivery means discharge a compressed air charge from the crankcase chambers into a first, and then a second compressor chamber positioned within the valley. Each of the cylinder heads have at least one intake port positioned on the valley side for serving the respective of the combustion chambers. Means supply a compressed charge from the second compressor chamber to the respective intake port.

At least one exhaust passage is formed in each of the cylinder heads, and is positioned generally opposite the intake port and on the opposite side of the engine from the valley. The exhaust passage is adapted to discharge exhaust products from the combustion chambers. An exhaust manifold is provided at least in part in the valley for collecting the exhaust gasses from the exhaust passages.

In one embodiment of the present invention, the crankshaft means comprises a first crankshaft corresponding to the first bank and a second crankshaft corresponding to the second bank. In a first arrangement, the first and second crankshafts are offset from a drive shaft of the water propulsion device of the motor. The first and second crankshafts are coupled in synchronous rotation by intermeshing gears, and one of the crankshafts is coupled to the drive shaft by a pair of intermeshing gears. In a second arrangement, one of the crankshafts is aligned with the drive shaft and coupled directly thereto.

As another aspect of the present invention, a lubricating system including an oil tank and oil pump is preferably provided. Preferably, the oil tank and pump are positioned opposite the valley of the engine near the intake system.

DETAILED DESCRIPTION OF THE PREFERRED EMBODIMENTS OF THE INVENTION

Figure 1:
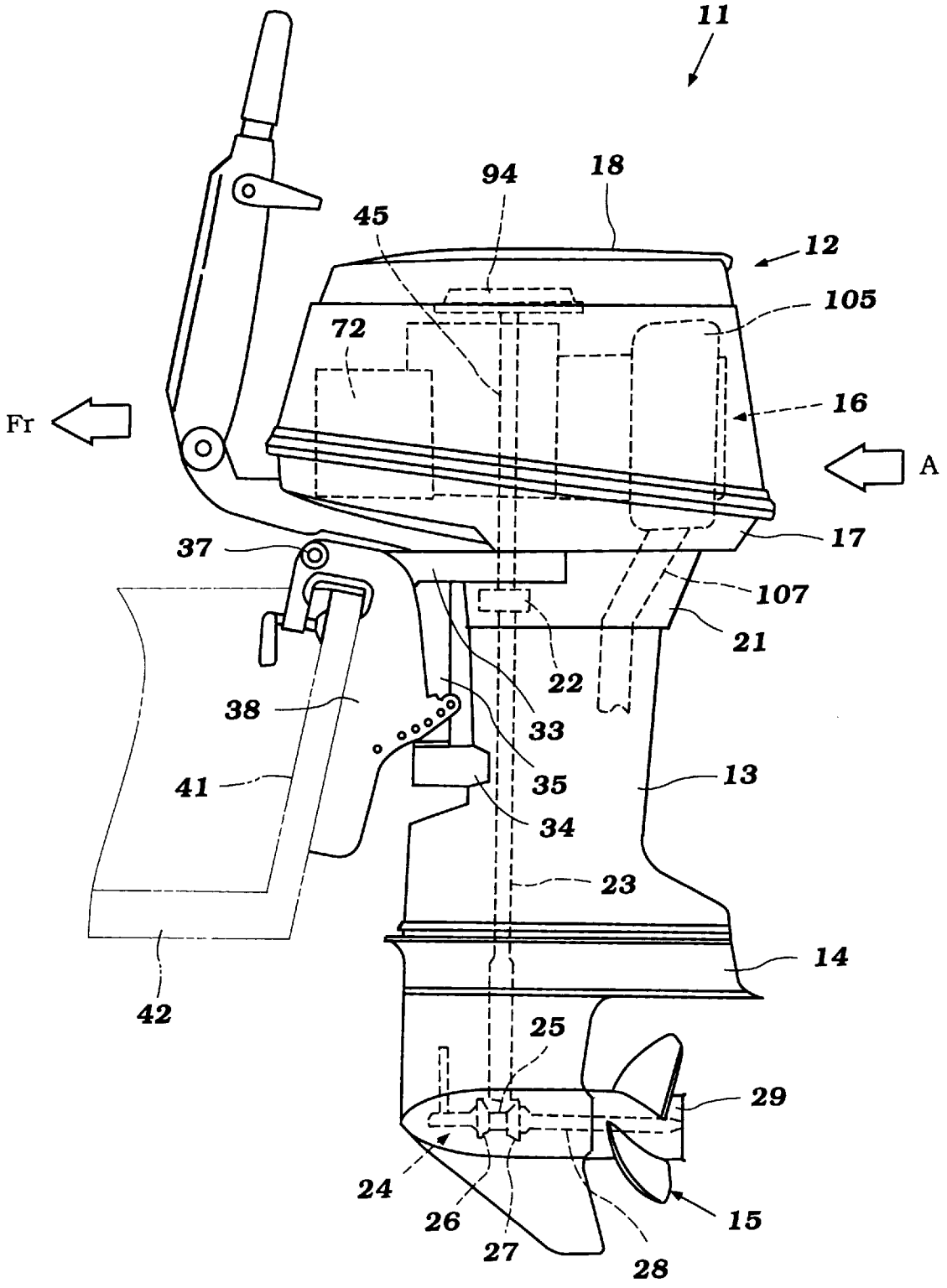
FIG. 1 is a side elevational view of an outboard motor constructed in accordance with a first embodiment of the invention shown attached to the transom of a watercraft, illustrated partially and in phantom, the motor powered by an engine positioned in a cowling thereof, the motor also illustrated in phantom.
Figure 2:
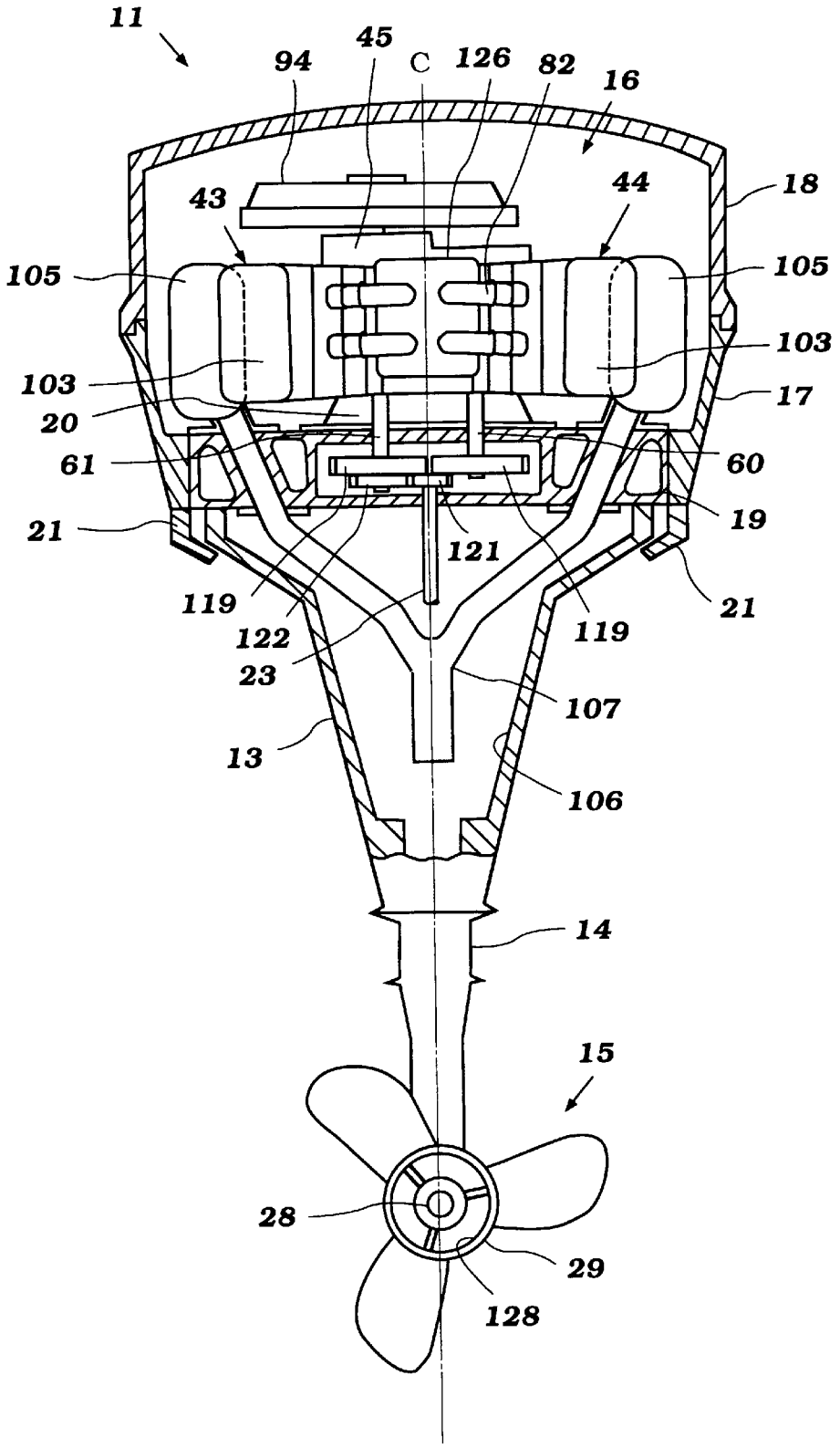
FIG. 2 is a cross-sectional rear view of the outboard motor looking in the direction of the arrow A in FIG. 1 illustrating the engine therein.

Referring first to the embodiment of the invention as shown in FIGS. 1–6 and initially primarily to FIGS. 1 and 2, an outboard motor constructed in accordance with this embodiment is indicated generally by the reference numeral 11. The invention is described in such an environment because it provides a compact, high specific output power plant as is required for outboard motors. As will be readily apparent to those skilled in the art, engines embodying the invention may be employed in other environments.

The outboard motor 11, as with most outboard motors, is comprised of a powerhead, indicated generally by the reference numeral 12, that is disposed above a drive shaft housing/lower unit assembly comprised of a drive shaft housing 13 and a lower unit 14.

A propulsion device such as a propeller 15 is supported in the lower unit 14 in a manner to be described and is driven by an internal combustion engine embodying the invention, indicated generally by the reference numeral 16 which forms a major portion of the powerhead 12.

The powerhead 12, in addition to the engine 16, is comprised of a protective cowling that is comprised primarily of a lower tray portion 17 and an upper main cowling portion 18 that is detachably connected to the tray portion 17 in any known manner. The tray portion 17 is typically formed from a relatively high strength lightweight material such as aluminum or aluminum alloy. The upper main cowling portion 18, on the other hand, is formed from an even lighter weight but less strong material such as a molded fiberglass reinforced resin or the like.

As may be seen best in FIG. 2, the engine 16 is mounted on a spacer plate or exhaust guide 19 which is positioned in the upper end of the drive shaft housing 13. A shroud or apron 21 may be formed around the upper portion of the drive shaft housing 13 and spacer plate 19 so as to provide a neater appearance and for sealing purposes.

As is typical without outboard motor practice, the engine 16 is supported within the powerhead 12 upon the spacer plate 19 so that its output shaft, to be described in more detail later, rotates about a vertically extending axis. This facilitates a coupling 22 of the output shaft or crankshaft to a drive shaft 23 which rotates about a generally vertically extending axis and which is journaled within the drive shaft housing 13 and lower unit 14.

In the lower unit 14, the drive shaft 23 drives a forward neutral reverse transmission, indicated generally by the reference numeral 24 and which may be of any known type. Basically, this transmission includes a driving bevel gear 25 that is fixed for rotation with the lower end of the drive shaft 23. This driving gear 25 drives a pair of diametrically opposed driven bevel gears 26 and 27 which rotate in opposite directions.

These driven bevel gears 26 and 27 are journaled on a propeller shaft 28 to which a hub 29 of the propeller 15 is affixed in a known manner. A dog clutching mechanism of a known type is provided for selectively coupling either the gear 26 or the gear 27 to the propeller shaft 28 so as to drive the propeller 15 in a forward or reverse direction. When this dog clutching element is positioned in a neutral position, the gears 26 and 27 rotate freely on the propeller shaft 28 and no propulsion is provided. This shifting is accomplished by means of a shift plunger 31 that is operated by a shift rod 32. The shift rod 32 extends upwardly to a shift control lever of any known type (not shown).

A steering shaft (not shown) is affixed to the drive shaft housing 13 by an upper bracket assembly 33 and a lower bracket assembly 34. This steering shaft is journaled for rotation in a swivel bracket 35 for steering of the outboard motor 11 in a known manner. A tiller 36 is affixed to the upper end of the steering shaft for steering of the outboard motor 11 in a well known manner.

The swivel bracket 35 is, in turn, pivotally connected by a pivot pin 37 to a clamping bracket 38. Pivotal movement about the pivot pin 37 permits tilt and trim movement of the outboard motor 11, as is also known in the art. A clamping mechanism 39 is carried by the clamping bracket 38 for detachably affixing the outboard motor 11 to a transom 41 of a watercraft hull, shown partially and indicated generally by the reference numeral 42.

The construction of the outboard motor 11 as thus far described may be considered to be conventional. Where any details of the outboard motor 11 are not described, those skilled in the art can readily resort to any known type of construction with which to practice the invention. The invention deals primarily with the construction of the internal combustion engine 16 and that now will be described by principal reference to FIGS. 3 through 6 although certain of the components also appear in FIGS. 1 and 2. Where that is the case, the reference numerals applied to them will be carried over into these earlier figures. For reference, the label Fr has been used to indicate the direction facing the watercraft.

The engine 16 is, in the illustrated embodiment, of a four-cylinder "V" type. Although the invention is described in conjunction with a four-cylinder engine, it should be readily apparent to those skilled in the art that the invention may be utilized in conjunction with any multiple number of cylinders. In the particular arrangement illustrated, the engine 16 is mounted to a mount 20 extending upwardly from the exhaust guide 19, so as to space the engine 16 above the exhaust guide 19 within the engine compartment defined by the cowling of the motor.

The engine 16 basically consists of a pair of cylinder banks 43 and 44 mounted on a common crankcase, indicated generally by the reference numeral 45. Each cylinder bank is comprised of a cylinder block, indicated by the reference numeral 46 and in which two horizontally disposed, vertically spaced, cylinder bores 47 are formed. At times the suffixes L and R will be used with the reference numerals to distinguish the components associated with the respective left and right cylinder banks.

One end of the cylinder bores 47 of each bank is closed by a respective cylinder head assembly, indicated generally by the reference numeral 48, which is detachably affixed, in the illustrated embodiment, to the cylinder block 46 in any known manner.

Each cylinder head assembly 48 includes a main cylinder head casting 49 that is formed with individual recesses 51 which cooperate with the cylinder bores 47 and pistons 52 that are slidably supported therein to form the combustion chambers of the engine. Because of the fact that the cylinder head recesses 51 form the major portion of the combustion chamber volume at top dead center, the reference numeral 51 will at times also be utilized to identify the combustion chambers.

The cylinder blocks 46 have cylindrical extensions 53 around the cylinder bores 47 that are received within complimentary openings 54 of the crankcase member 45. This crankcase member 45 is affixed to the cylinder blocks 46 in a known manner and functions, among other things, to close the ends of the cylinder bores 47 below the pistons 52. In the illustrated embodiments the "V" angle between the cylinder banks is 45°, although other angles are obviously possible depending on the specific application.

Connecting rods 55 are connected by piston pins 56 to the pistons 52. The pistons 52 are formed with recessed areas 57 that are engaged by the small ends of the connecting rods 55 so as to form a pivoting seal between the ends of the connecting rods 55 and the pistons 52 for a reason which will be described.

The lower or big ends of the connecting rods 55, indicated by the reference numeral 58 are journaled on throws 59 of a respective crankshaft 60,61. Adjacent each throw 59, the crankshaft 60,61 is formed with disk-like members 62 that cooperate with the interior surface of the crankcase member 45 so as to define a pair of side by side series of individual crankcase chambers 63 each of which is associated with a respective cylinder bore 47 of the respective cylinder bank 43 or 44. The chambers 63 associated with each cylinder bank 43 or 44 are basically sealed by sealing surfaces 64 disposed on opposite sides of each throw 59 and which cooperate with the crankshaft disk-like portions 62 to provide axial seals and to seal one crankcase chamber 63 from the other.

The crankshafts 60,61 are rotatably joumaled in the crankcase member 45 at journalled portions 117 thereof, about parallel axes by a plurality of main anti-friction bearings, indicated generally by the reference numeral 65. As described in the aforenoted U.S. Pat. No. 5,377,7634, the connecting rods 55 functions at times to divide the crankcase chamber 63 into a first, intake side A and a second, delivery side B. The crankshafts 60,61 rotate in opposite directions so that the intake sides A lie opposite each other and opposite the valley side of the engine. The delivery sides B lie on adjacent inner sides of the respective cylinder bank 43 and 44 facing the valley. This is done to simplify the induction and exhaust systems, as will become apparent.

Figure 3:
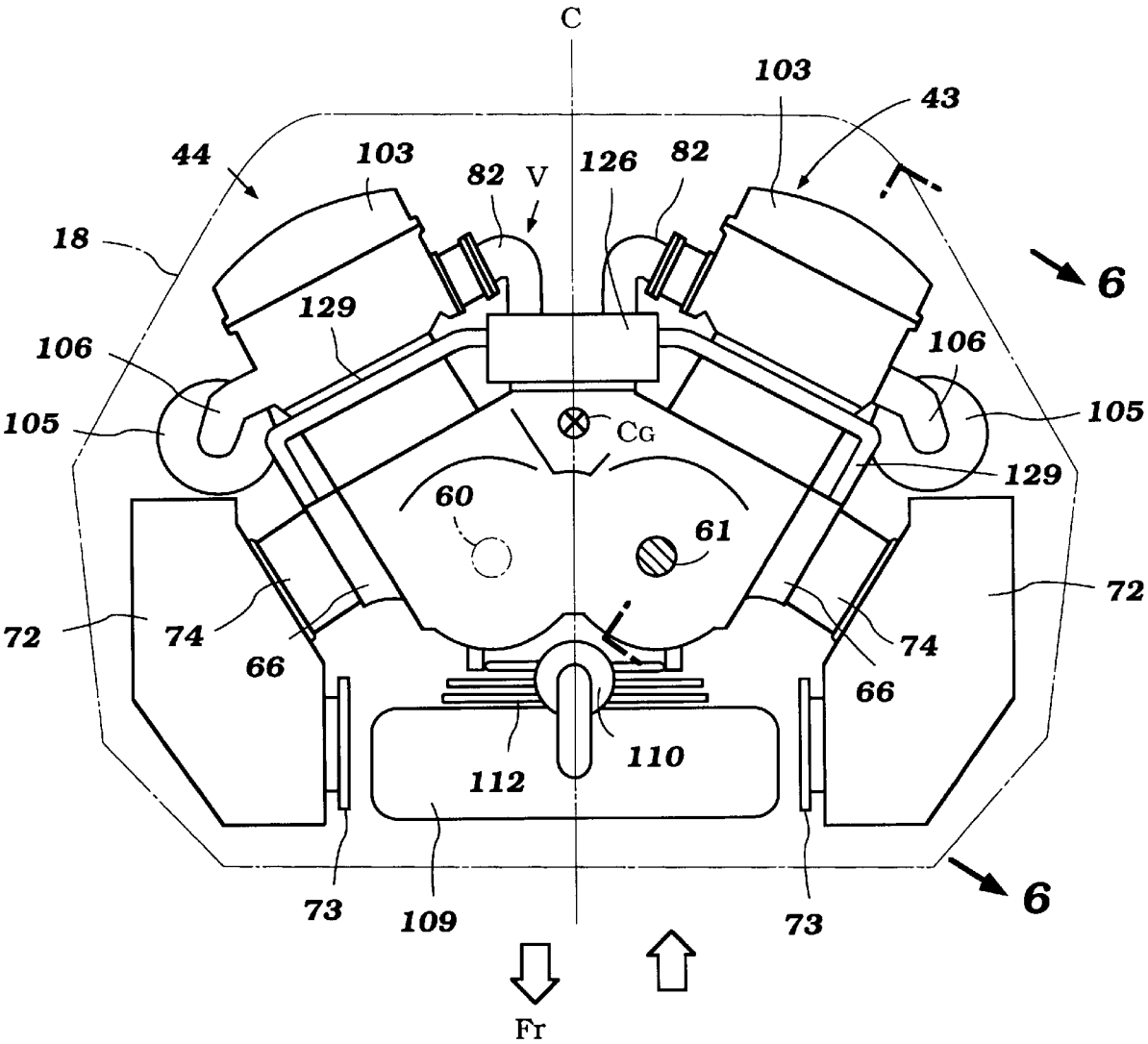
FIG. 3 is an enlarged top plan view of the powerhead of the outboard motor with the engine shown in solid lines and the protective cowling shown in phantom.

An air charge is delivered to the intake side A of each bank by an induction system which is generally positioned on opposite sides of the engine 16 (FIG. 3). Opposing portions of the crankcase member 45 are formed with an opening 67. A charging chamber housing 66 is affixed to the crankcase member 45. This housing 66 defines a charging chamber D which communicates with the crankcase intake sides A via the intake passages 67. The passages or ports 69 are actually valved by reed or similar valves 70 and the connecting rods 55, such that during the downstroke of the piston 52, the crankcase chamber part A is closed off from the charging chamber D, while at other times (during the upstroke) the port 69 is open end.

As is well known in the outboard motor art, the main cowling member 18 is provided with an atmospheric air inlet opening which does not appear in the figures but which permits intake air to be drawn into the protective cowling. This air is then delivered through an air inlet, indicated generally by the reference numeral 73 of a combined air cleaner and air box 72. An air cleaner 72 is provided for each bank 43,44, and conveniently positioned within the cowling in the otherwise empty space on either side of the crankcase member 45, as best illustrated in FIG. 3. The air cleaner 72 may provide a silencing and air cleaning function.

Air entering the air cleaner 72 passes therethrough into one or more carburetors 74. The carburetor 74 has conventional circuits and may be of any known type. It, in turn, delivers a fuel/air charge to the charging chamber D defined by the housing 66. Thus, a fuel/air charge is drawn through the air cleaner 72 into the crankcase chambers 63 during the upstroke of the pistons 52 much like in a two-cycle crankcase compression engine.

The charge which is drawn into the crankcase chambers 63 is trapped in the delivery side B when the connecting rods 55 and pistons 52 move toward their bottom dead center positions. They then act to compress the charge and deliver it to a delivery system generally by the reference numeral 76 and which is disposed in totality in the valley V of the engine 16.

The delivery system is comprised of two chambers, a first chamber C1 and a second chamber C2. The first chamber C1 is formed by the crankcase member 45 cooperating with a cover member 77. The chamber C1 thus formed is elongate and extends through the valley V of the engine 16 from top to bottom.

A compressor port 79 is formed in the side of the crankcase member 45 communicating with this chamber C1 and is valved by the respective connecting rod 55 and a reed type valve assembly 81 so as to ensure trapping of the compressed charge in the chamber C1.

A passage 125 extends from the first chamber C1 to the second chamber C2. The second chamber C2 is defined by a housing 126 which engages the cover member 77. The housing 126 preferably includes a hollow exterior wall space 127 for isolating the air and fuel charges delivered thereto from the heat of the engine 16.

A bypass passage 129 extends from each charging chamber D to the second chamber C2. Preferably, each bypass passage 129 is throttled with a butterfly-type throttle plate 130. In the event the pressure in the second compression chamber C2 becomes too high, the pressure is relieved through the bypass passages 129 and back to the charging chambers D. Thus, the plates 130 are biased to open the passages 129 above a predetermined pressure.

An intake pipe, indicated by the reference numeral 82 extends from within the second chamber C2 to a throttle body assembly 83. Each throttle body assembly 83 includes a butterfly-type throttle valve 84 that control the flow of charge to a respective intake passage 85 formed on this same side of the engine 16. The throttle valves 84 are controlled by a remote throttle actuator in any known manner.

The intake passages 85 terminate at intake ports that are valved by intake valves 86 that are slidably supported in the respective cylinder head member 49 in a known manner. Coil compressions springs 87 hold these intake valves 86 in their closed position. Intake rocker arms 88 are journaled in the respective cylinder head assembly 48 on intake rocker arm shaft 89. These rocker arms 88 are operated by the intake cams of a camshaft 91 that is journaled for rotation in the respective cylinder head assembly 49.

The camshafts 91 are driven at one-half crankshaft speed by a timing chain 92 (FIGS. 5 and 6) that is engaged with a sprocket 90 fixed to the upper end of the camshaft 91 and a sprocket affixed to the upper end of the respective crankshaft 60,61, which sprocket is indicated by the reference numeral 93. Hence, the charge which has been compressed in the crankcase chamber and stored in the compression chamber C will be delivered under pressure into the combustion chambers 51 when the intake valves 86 open on the intake stroke.

This charge will be further compressed in as the pistons 52 move toward their top dead center position on the compression stroke. The charge is then fired by spark plugs (not shown) that are mounted in the respective cylinder head assembly 48 by means of an ignition system which may include flywheel magneto assembly 94 that is driven off of the upper end of one of the crankshafts 61 and is connected for rotation therewith.

The charge which is ignited by the spark plugs will burn and expand to drive the pistons 52 in a well known manner during the power stroke. During the exhaust stroke, the charge is discharged from the combustion chambers 51 through exhaust ports formed on the valley side of the cylinder heads opposite to the intake passages 85 and which communicate with exhaust passages 97.

These exhaust ports are valved by exhaust valves 98 which are normally urged to a closed position by coil compression springs 99. These exhaust valves 98 are opened by exhaust rocker arms 101 joumaled on an exhaust rocker arm shaft 102 that is mounted in the cylinder head assembly 48. These exhaust rocker arms 101 are operated by exhaust cam lobes formed on the camshaft 91.

The valve actuating mechanism thus far described is contained within a valve actuating chamber that is closed by a cam cover 103 that is affixed to the respective cylinder head casting 49 and which completes the cylinder head assembly 48.

The exhaust gases that are discharged from the cylinder head passages 97 are delivered to an exhaust manifold assembly, indicated generally by the reference numeral 104. This exhaust manifold assembly 104 includes a collector section 105 corresponding to each bank 43,44, each collector section 105 positioned opposite the valley V of the engine 16 and adjacent the respective air cleaner 72. Individual runner pipes 106 extend from each exhaust passage 97 of each cylinder head to the collector section 105.

The manifold 104 is generally "Y"-shaped and has branches extending from the collector sections 105 through the exhaust guide 19, which branches meet at an exhaust pipe portion 107 which terminates in an expansion chamber 108 formed in the drive shaft housing 13. The exhaust gasses are discharged to the atmosphere from this expansion chamber 108 through a suitable discharge system which may include a through-the-propeller hub underwater discharge 128 (see FIG. 2) and a more restricted above-the-water low speed discharge. Such systems are well known in the art and since they form no significant part of the invention, further description is not believed to be necessary.

The engine 16 is preferably water cooled and water for its cooling is drawn from the lower unit 14 by a water pump driven off of the lower end of the drive shaft 23 in a well known manner. The cylinder block 46 and cylinder head 49 are formed with cooling jackets (now shown) through which this water is circulated.

The engine 16 is also provided with a lubricating system which may include a four-cycle type of lubricating system that delivers lubricant to the piston 52 through the walls of the cylinder blocks 46, for example, through delivery ports 115.

As illustrated, oil is drawn by an oil pump 110 from an oil tank, indicated generally by the reference numeral 109. Preferably, the oil tank 110 and pump 110 are positioned at on the side of the crankcase member 45 opposite the valley V of the engine 16. Supply lines 112 extend from the pump 110 to various portions of the engine 16 for supplying oil thereto, as is well known. As illustrated, these areas include the throws 59 of the crankshafts 60,61 and the cylinder bores 47.

Figure 4:
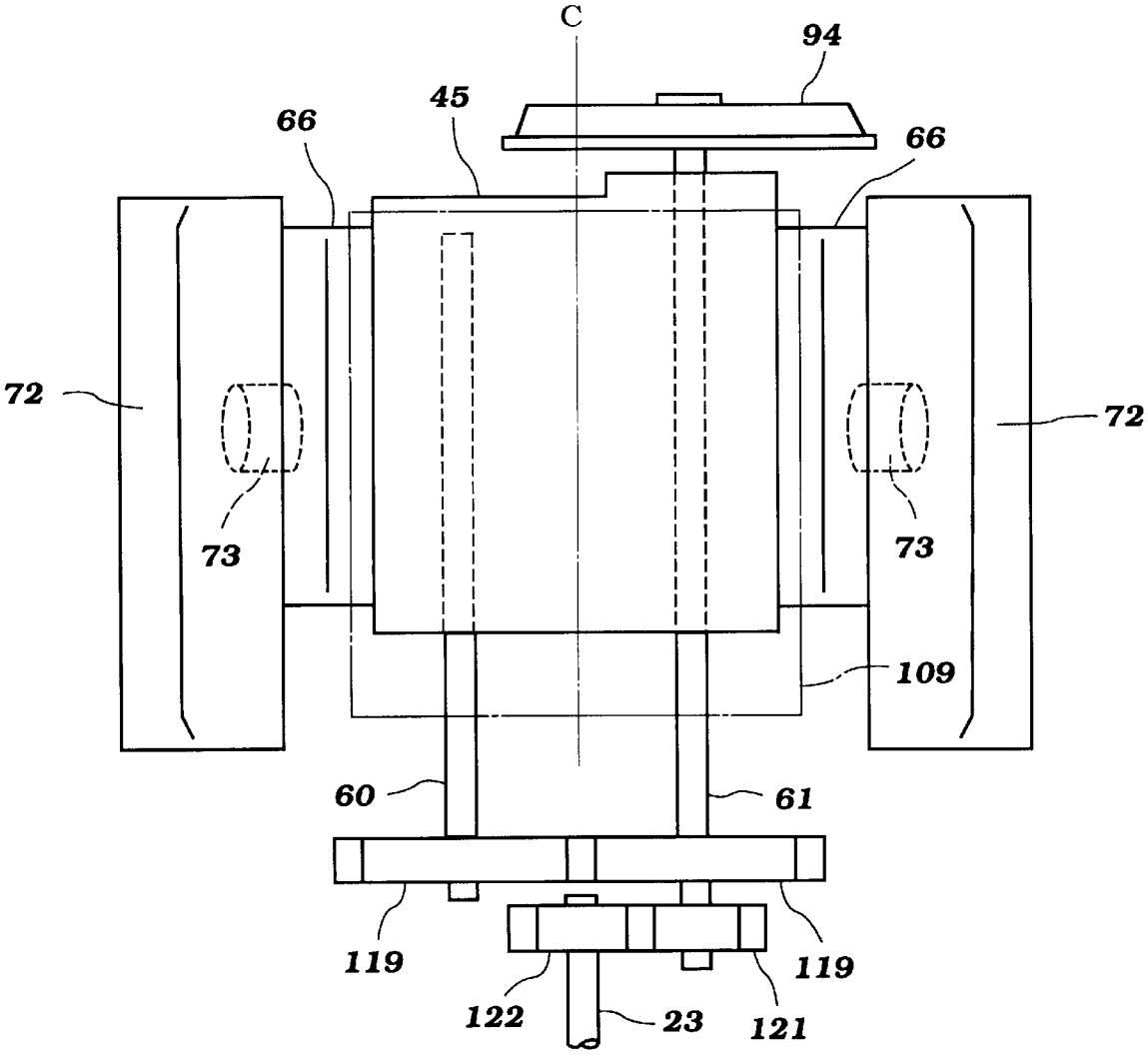
FIG. 4 is a side plan view of the engine powering the motor illustrated in FIG. 1.
Figure 5:
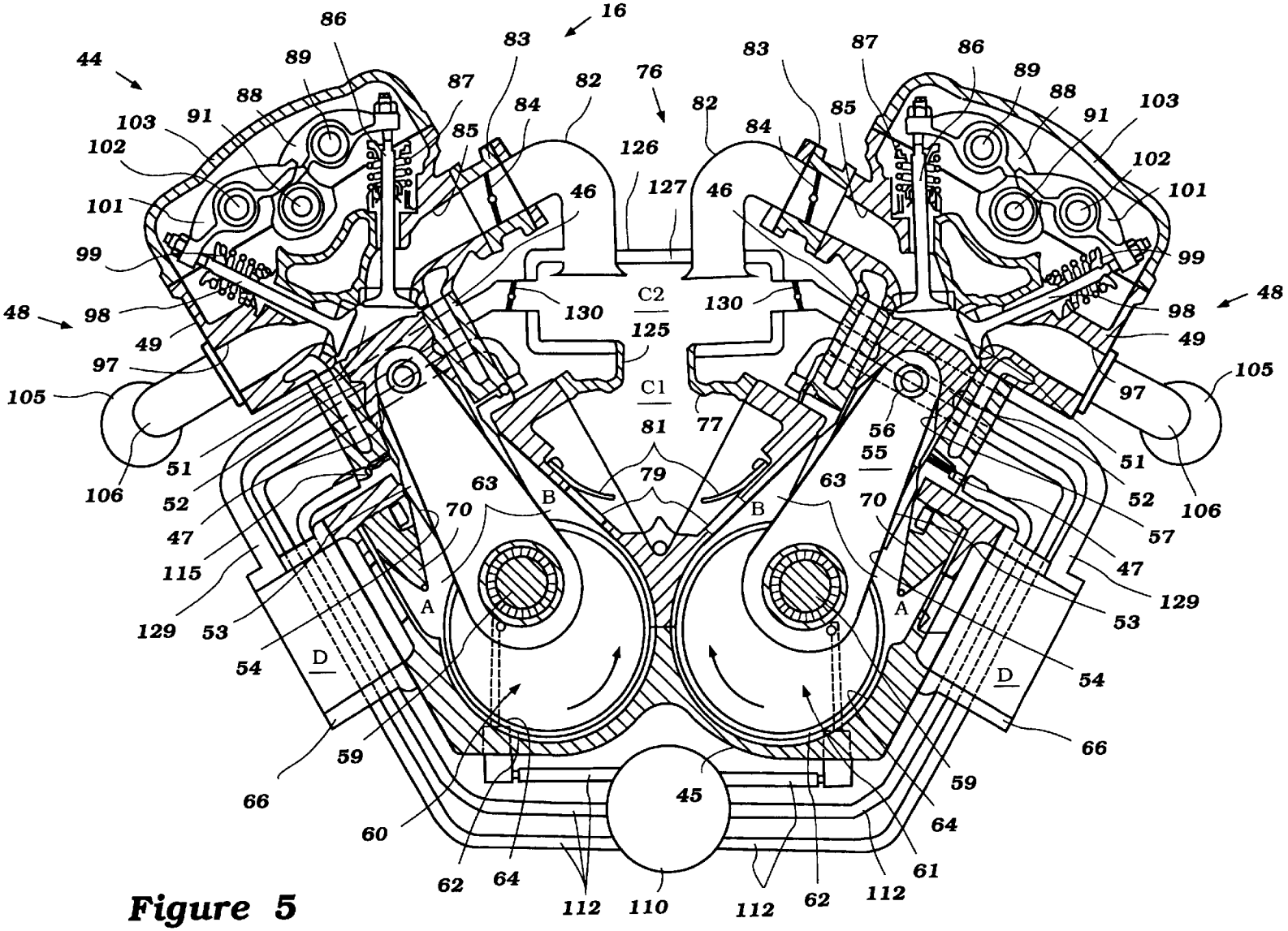
FIG. 5 is a cross-sectional top view of the engine powering the motor illustrated in FIG. 1.
Figure 6:
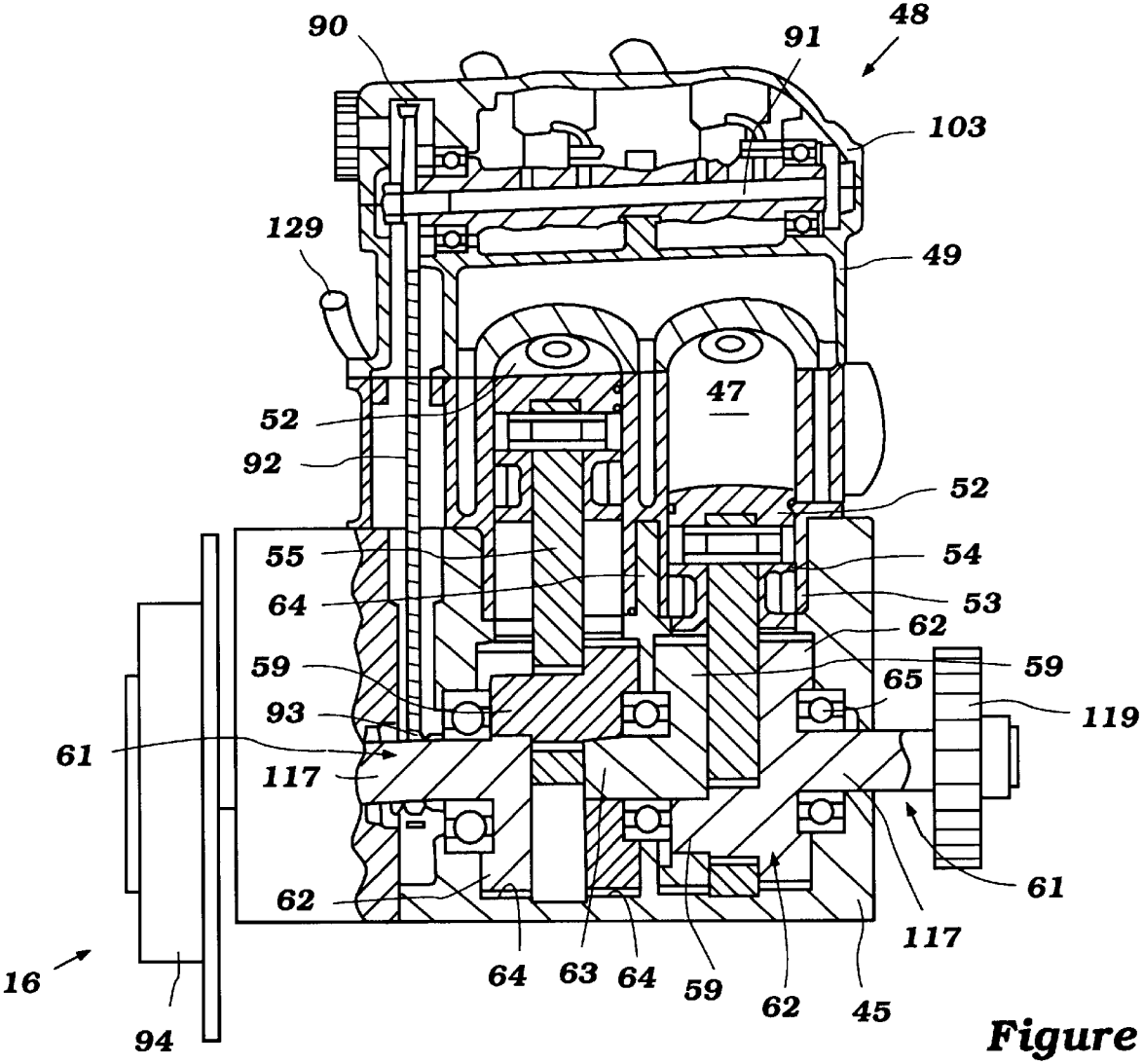
FIG. 6 is an enlarged cross-sectional view of the engine taken along line 6—6 of the engine illustrated in FIG. 3.

As may be seen, the construction of the engine and the positioning of the components is such so that the center of gravity $C_G$ will be disposed fairly centrally of the powerhead 12. In particular, and as illustrated in FIGS. 3 and 4, a central axis C extends through the engine 16, with the center of gravity $C_G$ positioned on this axis.

In this embodiment, the crankshafts 60,61 have their rotational axes offset from the drive shaft 23. In order to provide timing between the two crankshafts 60,61 and to accommodate driving of the drive shaft 23, a transmission mechanism is provided that is shown in most detail in FIG. 4. This transmission mechanism includes a first pair of intermeshing gears 119 that are affixed to the lower ends of the two crankshafts 60,61 and which will maintain synchronous rotation of the crankshafts 60,61.

In addition, one crankshaft 61 has affixed to it a timing gear 121 which forms a portion of the aforenoted coupling 22 for driving the drive shaft 23. This gear 121 is enmeshed with a second gear 122 that is affixed to and drives the upper end of the drive shaft 23.

Figure 7:
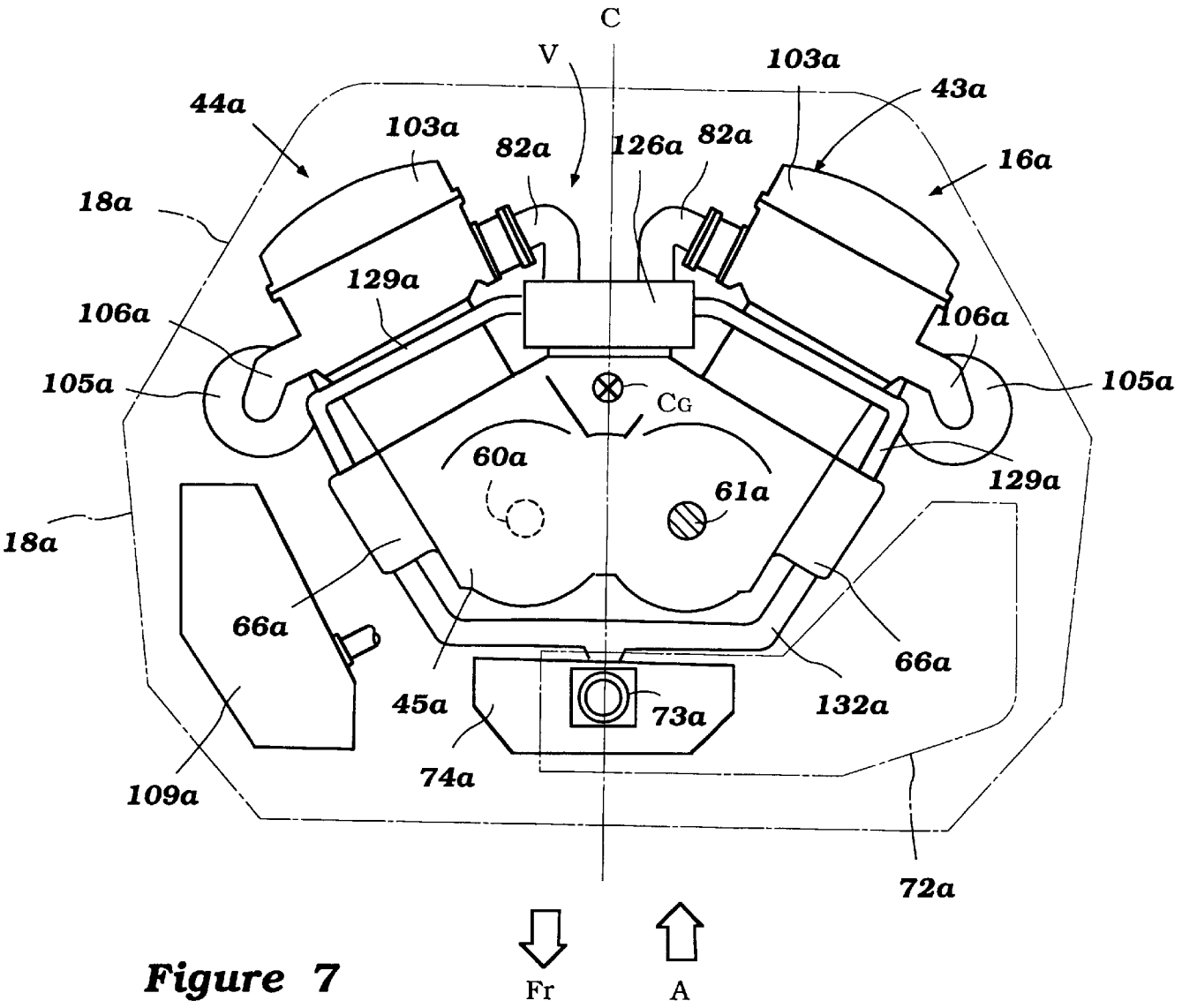
FIG. 7 is an enlarged top plan view of the powerhead of an outboard motor in accordance with a second embodiment of the present invention, with an engine shown in solid lines and the protective cowling shown in phantom.
Figure 8:
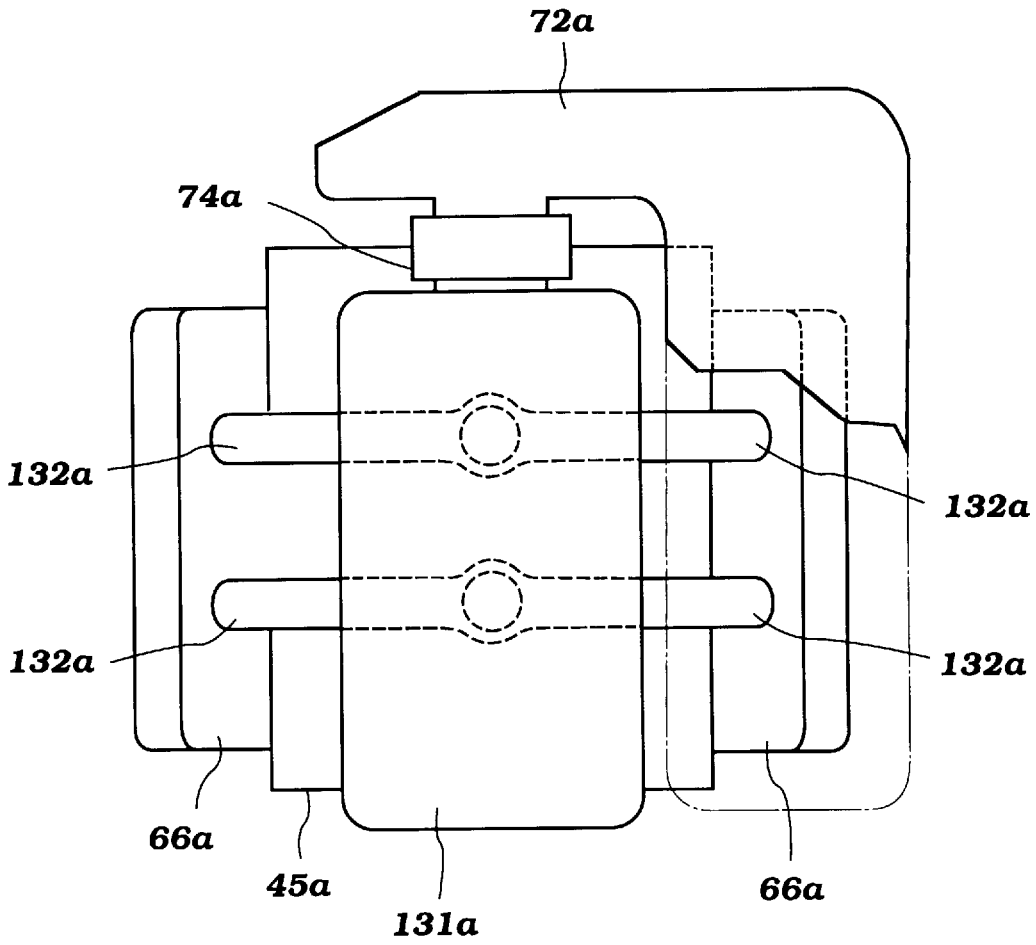
FIG. 8 is a side plan view of the engine powering the motor illustrated in FIG. 7 looking in the direction of arrow A therein.

FIG. 7 and 8 show a second embodiment of the present invention. This embodiment is similar in many respects to the first embodiment engine 16 illustrated above, and as such, like numerals have been utilized for like parts to those used in the description and illustration of the first embodiment, except that an "a" designator has been added thereto.

In this second embodiment, the a single air intake 73*a* leads into a single air box 72*a*. As illustrated, the intake 73*a* is positioned at the side of the crankcase member 45*a* generally opposite the valley V of the engine 16*a*. The air cleaner 72*a* extends from under the intake 73*a* along one side of the engine 16*a*.

Air passes from the air box 72*a* through a carburetor 74*a* into a surge tank or chamber 131*a* extending along the end of the engine 16*a* from top to bottom. Runners 132*a* extend from the tank 131*a* to each intake housing 66*a* leading into the crankcase of the engine.

In this arrangement, the oil tank 109*a* is positioned at the side of the engine 16*a* generally opposite the air cleaner 72*a*.

Figure 9:
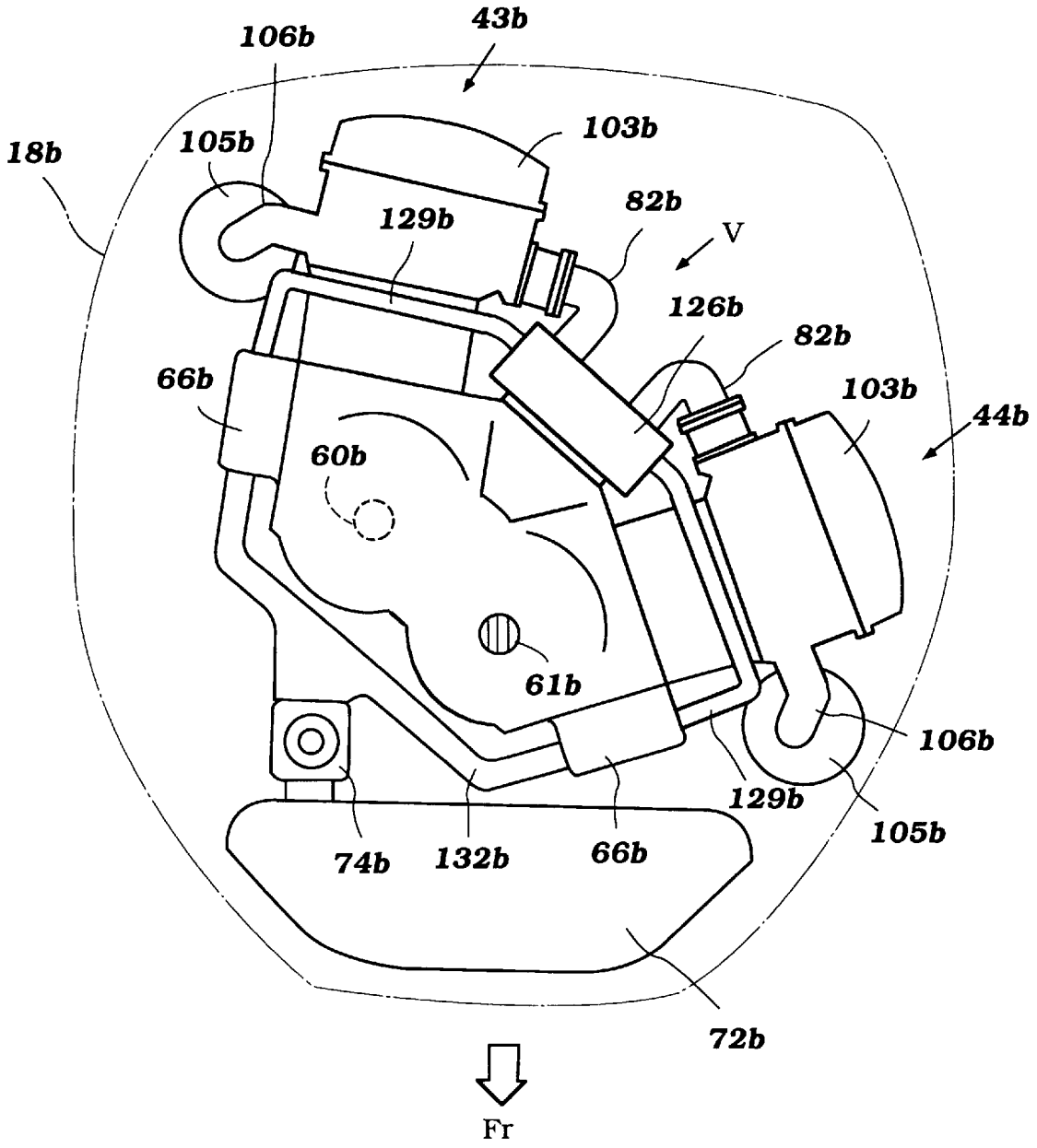
FIG. 9 is an enlarged top plane view of the powerhead of an outboard motor in accordance with a third embodiment of the present invention, with an engine shown in solid lines and the protective cowling shown in phantom.
Figure 10:
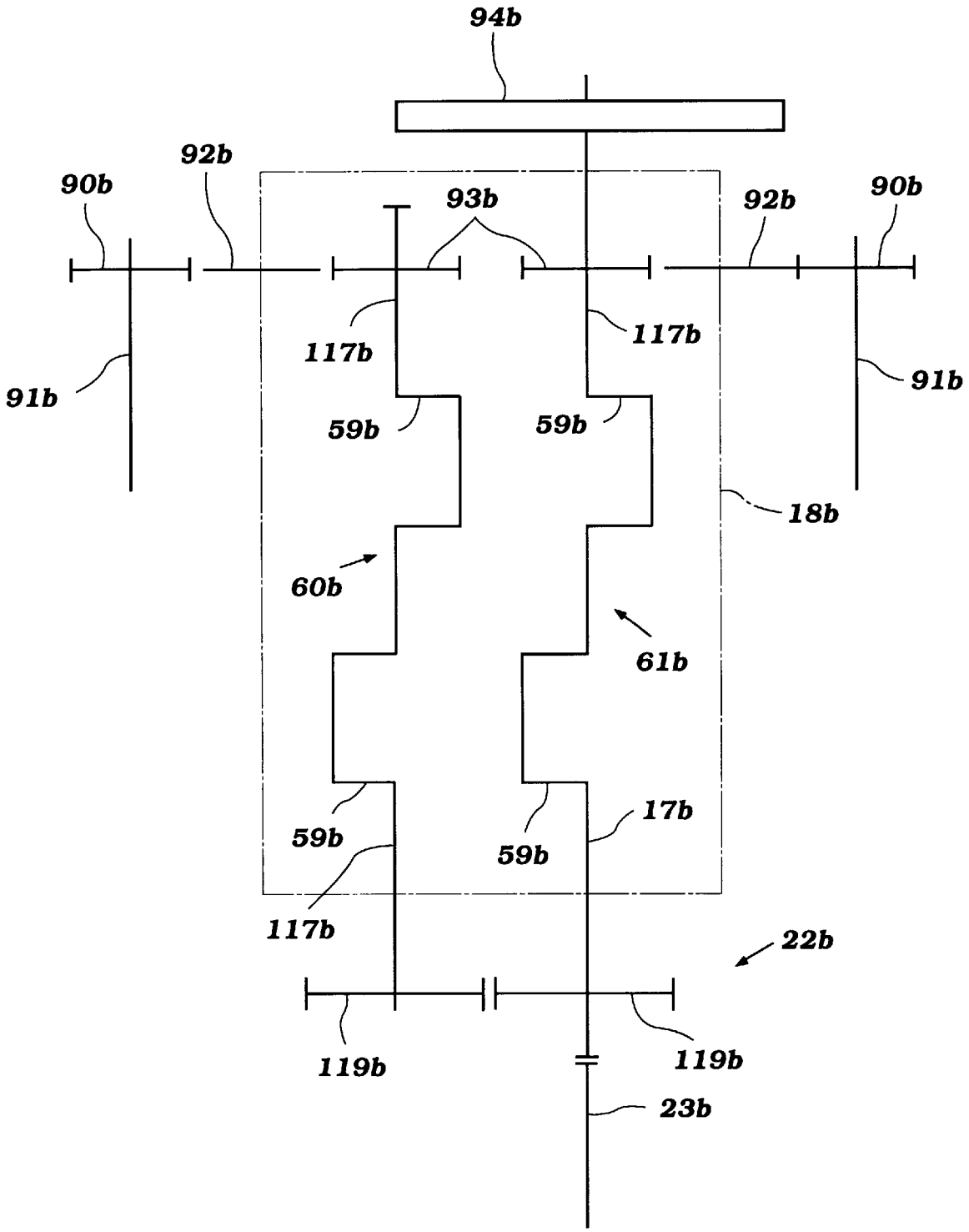
FIG. 10 is a schematic illustrating a crankshaft coupling and water propulsion unit drive arrangement for a motor having the engine in accordance with the third embodiment of the present invention and illustrated in FIG. 9.

A third embodiment of the present invention is illustrated in FIGS. 9 and 10. As with the last embodiment, like numerals are given to like parts to those described and illustrated in the first embodiment, except that a "b" designator has been added thereto. In this embodiment, the engine 16*b* positioned with the cowling 18*b* of the motor such that one of its crankshafts 61*b* is aligned with the drive shaft 23*b* extending to the transmission of the motor.

As illustrated, the engine 16*b* is rotated from the positioned illustrated in the first embodiment (FIG. 3). With the crankshaft 61*b* aligned with the drive shaft 23*b*, the two shafts may be directly coupled. The other crankshaft 60*b* is still maintained in synchronous rotation with the first crankshaft 61*b* with a pair of intermeshing gears 119*b*.

Thus, from the foregoing description it should be readily apparent that the described embodiments of the invention provide very compact and nevertheless high output four-cycle engines because of their incorporation of crankcase compression and a "V" type configuration. Also, it should be readily apparent that the specific outboard motor applications are merely typical of the environments in which this compact engine construction may be utilized.

Of course, the foregoing description is that of preferred embodiments of the invention, and various changes and modifications may be made without departing from the spirit and scope of the invention, as defined by the appended claims.

What is claimed is:

1. An outboard motor for use in propelling a watercraft, the motor having a water propulsion device powered by a four cycle, "V" type, internal combustion engine, said engine positioned within a cowling of said motor and comprising a pair of cylinder blocks disposed at a "V" angle to each other and forming a valley therebetween, each of said cylinder blocks having at least one cylinder bore, a crankcase at one end of said cylinder bores and forming a plurality of crankcase chambers each associated with a respective cylinder bore, a pair of cylinder heads closing the other end of said cylinder blocks, a plurality of pistons each reciprocating in a respective one of said cylinder bores and forming with said cylinder bores and said cylinder heads a plurality of combustion chambers, crankshaft means rotatably journalled in said crankcase, a plurality of connecting rods each coupled to a respective one of said pistons and said crankshaft means for transmitting motion therebetween, means for providing a seal so that said pistons, said cylinder bores, said connecting rods, said crankshaft means and said crankcase chambers act as a plurality of positive displacement pumps, intake means for admitting an air charge to said crankcase chambers positioned adjacent said crankcase on an opposite end of said engine from said valley, delivery means for discharging a compressed air charge from said crankcase chambers towards said valley, at least one compressor chamber positioned within said valley for receiving the compressed charge therefrom the respective crankcase chamber, each of said cylinder heads having at least one intake port facing said valley for serving the respective of said combustion chambers, means for supplying a compressed charge from said compressor chamber to said intake ports, at least one exhaust passage formed in each of said cylinder heads and facing generally opposite said valley for discharging exhaust products from said combustion chambers, an exhaust manifold for collecting the exhaust gasses from said exhaust passages, said crankshaft means arranged in driving relation with a drive shaft of said water propulsion device.

2. The outboard motor in accordance with claim 1, wherein the crankshaft means comprises a first crankshaft corresponding to one cylinder block and a second crankshaft corresponding to the other cylinder block, each crankshaft associated with the piston of its respective cylinder block.

3. The outboard motor in accordance with claim 2, wherein the first and second crankshafts rotate in opposite directions.

4. The outboard motor in accordance with claim 3, further including transmission means joining the crankshafts for synchronizing their rotation.

5. The outboard motor in accordance with claim 4, wherein said transmission means comprises a pair of intermeshing gears.

6. The outboard motor in accordance with claim 2, wherein said first and second crankshafts are offset from said drive shaft, and including drive means joining one of the crankshafts and the drive shaft.

7. The outboard motor in accordance with claim 2, wherein said first crankshaft is aligned with said drive shaft and coupled thereto.

8. The outboard motor in accordance with claim 1, wherein the intake means comprises an air box having an air intake.

9. The outboard motor in accordance with claim 8, wherein an air box is provided for each cylinder block.

10. The outboard motor in accordance with claim 8, where a single air box is provided and at least one runner extends therefrom to each crankcase chamber.

11. The outboard motor in accordance with claim 1, wherein a centerline bisects said motor in a forward and rear direction and a center of gravity of said engine is positioned on said centerline.

12. The outboard motor in accordance with claim 1, further including an oil supply and a oil delivery mechanism for delivering oil from said supply to said engine, said oil supply and delivery mechanism positioned adjacent said engine opposite said valley.

13. The outboard motor in accordance with claim 1, wherein a first compressor chamber is formed integrally with said engine in said valley and a second compressor chamber is positioned adjacent said first compressor chamber in said valley and in communication therewith.

14. The outboard motor in accordance with claim 13, wherein at least one bypass passe extends from said second compressor chamber to at least one of said crankcase chambers.

15. The outboard motor in accordance with claim 1, wherein the means for providing a seal comprises means for forming a seal between one end of each of said connecting rods and the respective one of said pistons and between the sides of said connecting rods and the side surfaces of the respective of said crankcase chambers, said connecting rods each having a portion thereof in sealing engagement with said crankcase during at least a portion of a single rotation of said crankshaft means.

16. The outboard motor in accordance with claim 1, wherein the intake means for admitting the air charge to the crankcase chamber comprises intake ports disposed opposite said valley of said engine and the delivery means for discharging a compressed charge from the crankcase chambers comprises discharge ports disposed in the inner sides of said engine.

17. The outboard motor in accordance with claim 2, wherein said engine is oriented such that said first and second crankshafts are generally vertically extending.

18. The outboard motor in accordance with claim 1, wherein said "V" angle is less than 180 degrees.

* * * * *